US005530985A

United States Patent [19]

Tsai et al.

[11] Patent Number: 5,530,985

[45] Date of Patent: Jul. 2, 1996

[54] WIRE BRUSH

[76] Inventors: Chin-Tien Tsai, No. 40, Tou-Chang Lane, Tou-Nan Li, Lu-Kang Town, Changhua County, Taiwan; Shu-yen Tsai, No. 20, Alley 39, Lane 206, Sec. 2, Tai-Ho Rd., Ah-Yi Li, Changhua County, Taiwan

[21] Appl. No.: 556,656

[22] Filed: Nov. 13, 1995

[51] Int. Cl.[6] ..... A47L 17/08

[52] U.S. Cl. ..... 15/229.11

[58] Field of Search ..... 15/208, 209.1, 15/229.11, 229.12, 229.13

[56] References Cited

U.S. PATENT DOCUMENTS

| | | | |
|---|---|---|---|
| 2,059,099 | 10/1936 | Gorman | 15/229.11 |
| 2,350,357 | 6/1944 | Kelman | 15/229.11 |
| 2,601,771 | 7/1952 | Cameron | 15/229.11 |
| 4,287,633 | 9/1981 | Gropper | 15/229.11 |

FOREIGN PATENT DOCUMENTS

| | | | |
|---|---|---|---|
| 1233600 | 5/1960 | France | 15/209.1 |
| 887249 | 1/1962 | United Kingdom | 15/229.11 |
| 988236 | 4/1965 | United Kingdom | 15/229.11 |

*Primary Examiner*—Mark Spisich

*Attorney, Agent, or Firm*—Morton J. Rosenberg; David I. Klein

[57] ABSTRACT

A wire brush having a cylindrical body made from a nylon wire and an elastic plastic strip, which are put together and then woven on loop-like pull ropes, which are arranged in the cylindrical body in a parallel relation, the cylindrical body being turned inside out into an annular configuration, and then fixed in shape by tying up the loop-like pull ropes pair by pair.

1 Claim, 4 Drawing Sheets

WIRE BRUSH

BACKGROUND OF THE INVENTION

The present invention relates to wire brushes, and relates more particularly to such a wire brush which is made from a nylon wire and an elastic plastic strip by woven, suitable for cleaning teflon coated kitchen utensils.

Teflon has been intensively used as a coating for woks, pots, pans, etc., for the advantage of preventing sticking of food during cooking. However, the teflon coating of a kitchen utensil will be damaged easily if the kitchen utensil is washed with a metal wire brush. When the teflon coating of a kitchen utensil is damaged, the dust of teflon coating may be carried in food. If sponges or dishcloths are used for cleaning teflon coated kitchen utensils, they cannot effectively remove sticking bits of food from the teflon coating. Furthermore, sponges and dishcloths will absorb water and impurities in water, therefore they tend to be contaminated.

SUMMARY OF THE INVENTION

The present invention has been accomplished to provide a wire brush which eliminates the aforesaid problems. It is one object of the present invention to provide a wire brush which is specifically designed for cleaning teflon coated kitchen utensils without damaging the teflon coating. It is another object of the present invention to provide a wire brush which is not absorptive. According to the present invention, the wire brush is made from a nylon wire and an elastic plastic strip by weaving them on loop-like pull ropes into a cylindrical structure. The cylindrical body of the wire brush is then turned inside out into an annular configuration, and then fixed in shape by tying up the loop-like pull ropes pair by pair.

DETAILED DESCRIPTION OF THE PREFERRED EMBODIMENT

Figure 1:
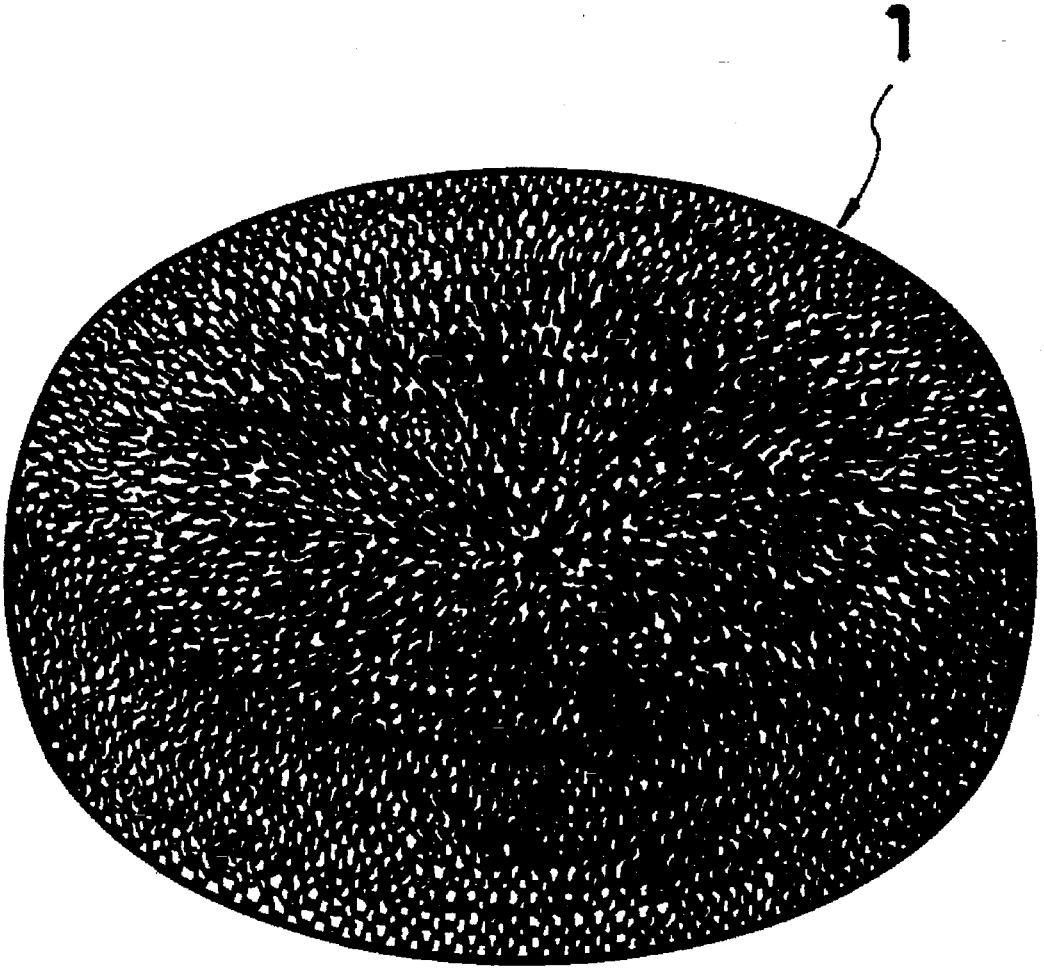
FIG. 1 is an elevational view of a wire brush according to the present invention.
Figure 2:
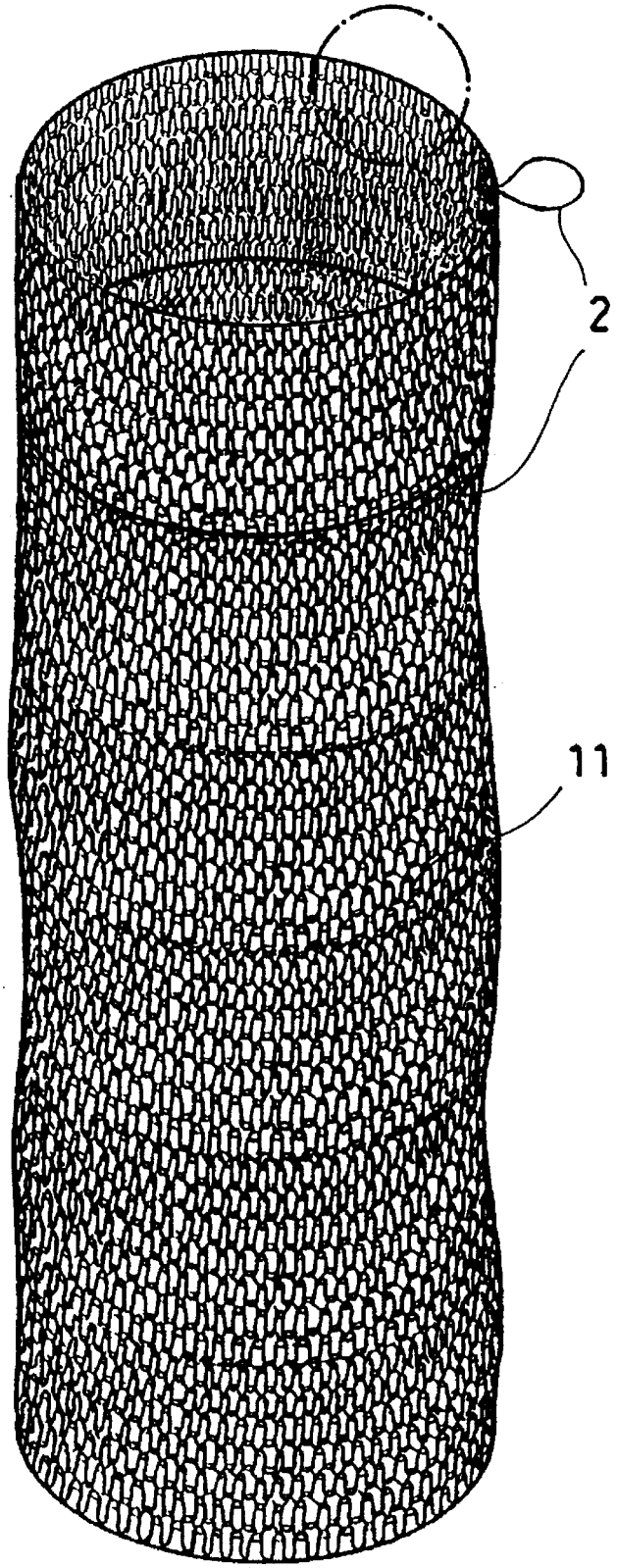
FIG. 2 is an extended-out view of the wire brush shown in FIG. 1.
Figure 3:
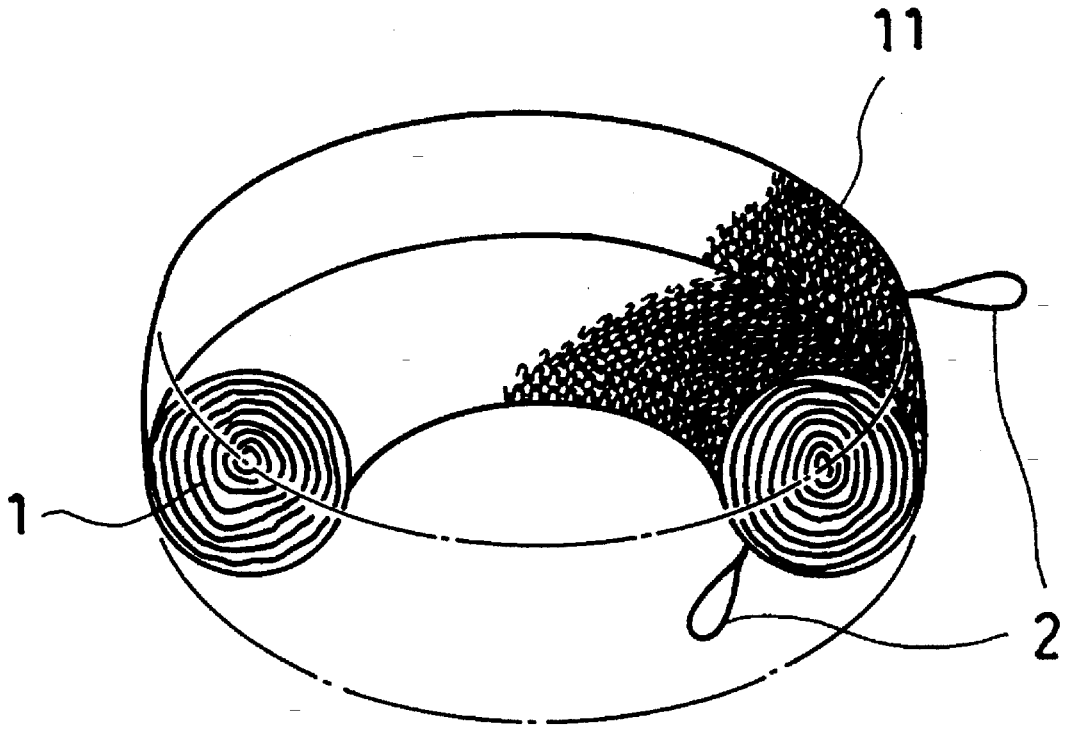
FIG. 3 is a perspective view of the wire brush shown in FIG. 1.
Figure 4:
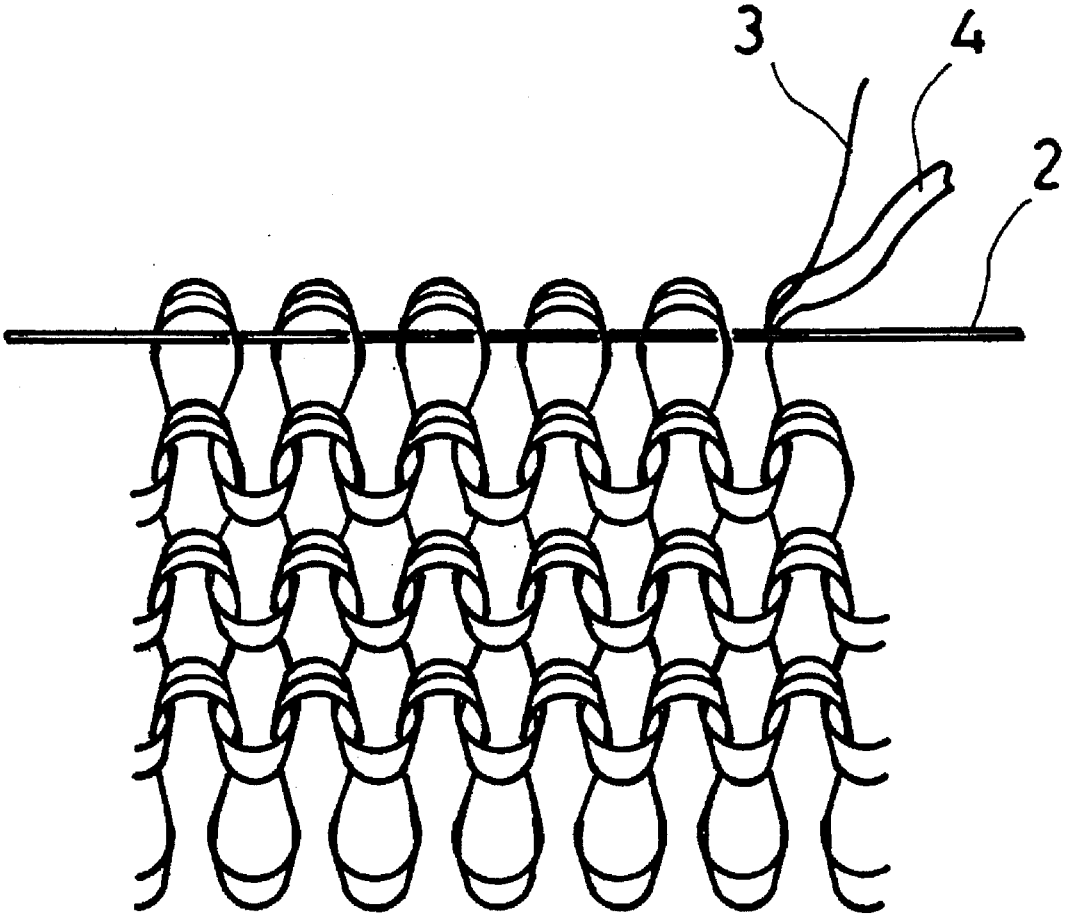
FIG. 4 is a partial view in an enlarged scale showing the detail structure of the wire brush shown in FIG. 1.

Referring to FIGS. 1, 2, 3, and 4, the wire brush, referenced by 1, is made of annular shape from a thin nylon wire 3 and an elastic plastic strip 4 by weaving. The nylon wire 3 and the elastic plastic strip 4 are put together and then woven with loop-like pull ropes 2 into a wire cylinder 11. The loop-like pull ropes 2 are arranged in the wire cylinder 11 in a parallel relation One end of the wire cylinder 11 is then turned inside out and rolled up into an annular configuration, and then the loop-like pull ropes 2 are respectively pulled in reversed directions and tied up pair by pair.

As indicated, the nylon wire 3 and the elastic plastic strip 4 are arranged together to form the body of the wire brush 1 and fixed in shape by the loop-like pull ropes 2. Because the wire brush is made from nylon wire 3 and elastic plastic strip 4, it is suitable for cleaning teflon coated woks, pots, and pans without damaging the coating of kitchen utensils. Furthermore, this structure of wire brush does not absorb water, therefore it can be maintained dry.

We claim:

1. A wire brush comprising a cylindrical body made from a nylon wire and an elastic plastic strip, which are put together and then woven on loop-like pull ropes, which are arranged in said cylindrical body in a parallel relation, said cylindrical body being turned inside out into an annular configuration, and then fixed in shape by tying up said loop-like pull ropes pair by pair.

* * * * *